US008245329B2

(12) United States Patent
Stein

(10) Patent No.: US 8,245,329 B2
(45) Date of Patent: Aug. 21, 2012

(54) AIR BLASTING DEVICES FOR PLUMBING PURPOSES TO CLEAN, CLEAR, UNCLOG, OR UNSTOP DRAINS OR PIPES

(76) Inventor: Harvey Lewis Stein, Annapolis, MD (US)

( * ) Notice: Subject to any disclaimer, the term of this patent is extended or adjusted under 35 U.S.C. 154(b) by 357 days.

(21) Appl. No.: 12/571,781

(22) Filed: Oct. 1, 2009

(65) Prior Publication Data

US 2010/0077541 A1 Apr. 1, 2010

Related U.S. Application Data

(60) Provisional application No. 61/101,742, filed on Oct. 1, 2008.

(51) Int. Cl.
*E03D 11/00* (2006.01)

(52) U.S. Cl. ..... 4/255.11

(58) Field of Classification Search ..... 4/255.01, 4/255.11, 255.12

See application file for complete search history.

(56) References Cited

U.S. PATENT DOCUMENTS

| | | | | |
|---|---|---|---|---|
| 2,844,826 | A * | 7/1958 | Cheiten | 4/255.11 |
| 5,423,621 | A | 6/1995 | Russell | |
| 6,055,680 | A | 5/2000 | Tolbert | |
| 6,898,807 | B2 * | 5/2005 | Tash | 4/255.01 |
| 7,089,605 | B2 | 8/2006 | Jiang | |
| 7,299,519 | B1 | 11/2007 | Garry | |
| D575,914 | S * | 8/2008 | Carty | D32/14 |
| 2005/0173277 | A1 * | 8/2005 | Rich | 206/349 |

* cited by examiner

*Primary Examiner* — Huyen Le
(74) *Attorney, Agent, or Firm* — John D. Gugliotta, PE, Esq.

(57) ABSTRACT

An improved plunger comprises a generally V-shaped handle attached to a top distal end of a shaft. The handle comprises two mirrored arms that face inwards from a base so that neither of them nor the shaft shares a vertical or a horizontal plane. The handle is removably detachable from the plunger so that it can be washed, disinfected, and sanitized. At least one extension shaft portion extends a height of the shaft when it is not collapsed into and housed in the hollow shaft.

14 Claims, 10 Drawing Sheets

AIR BLASTING DEVICES FOR PLUMBING PURPOSES TO CLEAN, CLEAR, UNCLOG, OR UNSTOP DRAINS OR PIPES

RELATED APPLICATIONS

The present invention claims benefit, and is a continuation of U.S. Provisional Patent No. 61/101,742 filed Oct. 1, 2008.

BACKGROUND OF THE INVENTION

1. Field of the Invention

The present invention relates generally to air blasting devices for plumbing purposes that clean, clear, unclog, or unstop drains or pipes and, more specifically, to improved devices having both an increased volumetric displacement and handle arms and a shaft all in separate planes.

2. Description of the Related Art

Toilet plungers are often found in near proximity to most restrooms, utility drains, and garbage disposals to remedy any unsightly, malicious blockages which tend to cause the plumbing system to fail. The most widely used plunger is a standard design having two components: a distal bottom of a generally vertical, wooden shaft attached to a crest of a plunger portion. There are a variety of designs for plunger portions, but they namely comprise inverted rubber cups with flat rims or flanges that form seals over the mouth of a drain or pipe. A push of the shaft towards the mouth causes the cup to depress, which forces any air and/or water therein towards the blockage to break up the clog.

An effective plunge is dependent on both the vacuum formed by the seal and the degree of force used on the shall. The present invention discloses an improved handle atop the shaft, which provides a better and more ergonomic means to manipulate the plunger. A search of the prior art reveals no references that teach the present invention: however, some patents are considered related:

U.S. Pat. No. 7,299,519 to Garry teaches a "combination toilet plunger and brush" wherein a crossbar member at the top of a handle includes a rotatable knob. A pivoting sleeve and a retractor grip with friction members allow a user to squeeze against the vertical handle.

U.S. Pat. No. 5,423,621 to Russell teaches a "garbage disposal cleaning device" having a vertical shaft with a perpendicularly bent handle at its distal top.

U.S. Pat. No. 7,089,605 to Jiang teaches a "telescoping plunger" having a rotatable, lockable gripping handle wrapped around the vertical, distal top telescoping member of a collapsible rod.

U.S. Pat. No. 6,055,680 to Tolbert furthermore teaches a "collapsible toilet plunger" having a plurality of telescoping sections that collapse the handle for easy concealable storage.

The foregoing references all direct a user to wrap his or her hands around a vertical shaft or a horizontal crossbar. The present invention improves on those grips by means of a handle that comprises two mirrored, opposing V-shaped arms at the distal end of a shaft angled in two planes. Neither arm nor the shaft shares a vertical or a horizontal plane; hence, all of the arms and the shaft travel in separate planes.

SUMMARY OF THE INVENTION

The present invention relates generally to an improved air blasting device for plumbing purposes, which cleans, clears, unclogs or unstops drains or pipes.

It is a feature of the present invention to provide a plunger having a construction that provides for increased volumetric displacement.

It is an object of the invention to provide an improved shaft portion which further provides for better and more forceful plunges.

It is a first object of the shaft to comprise a handle at its opposing distal top. It is an object that the handle comprises two mirrored, opposing arms extending outward from that distal top. It is an object that neither arm nor the shaft shares any vertical or horizontal plane with another.

It is an object that the handle is inclined and inward facing to provide the user with a more ergonomic grasp, as well as to provide for a more forceful plunge.

It is a further object to provide a plunger that can be easily concealed in a cabinet or other limited space. It is an object that the shaft comprises a plurality of portions that collapse and/or disassemble so that the plunger is easily stored and concealed. It is another object that the portions dismember so that the top and the handle can be sanitized and washed. It is an object that the top portion most closest to the handle and the handle are manufactured from a material that is durable, easily sanitized, and repeatably washable.

It is an object that the shaft portions are securely lockable so that there is no risk that a forceful plunge will rather direct force to collapsing the shaft instead of unclogging the toilet/drain at it mouth.

It is envisioned that the present invention comprise an improved rubber plunger cup having a threaded attachment means attached to its crest. A first shaft portion is threadingly attached to the opposing end of attachment means. At least a second extension shaft portion is threadingly attached to the opposite distal end of the first shaft portion. An inward facing V-shaped handle is threadingly attached to the distal top of the last shaft portion.

It is a final object of the present invention that the extension shall portion can be contained and stored in the main shaft portion.

BRIEF DESCRIPTION OF THE DRAWINGS

Advantages and features of the present invention are better understood with reference to the following and more detailed description and claims taken in conjunction with the accompanying drawings, in which like elements are identified with like symbols, and in which:

DESCRIPTION OF THE PREFERRED EMBODIMENTS

Figure 1:
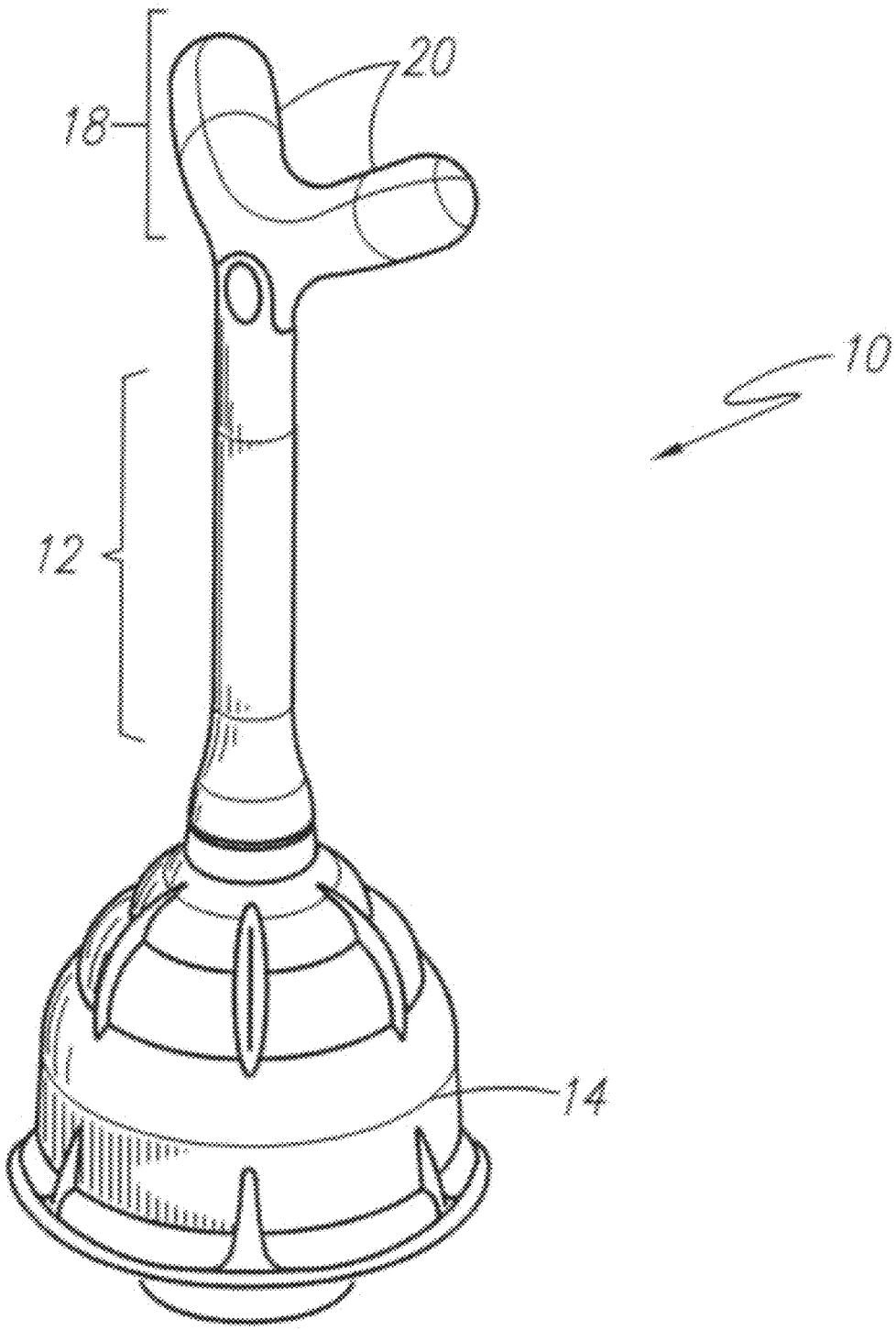
FIG. 1 is a perspective view of an improved plunger according to a preferred embodiment of the present invention.
Figure 2:
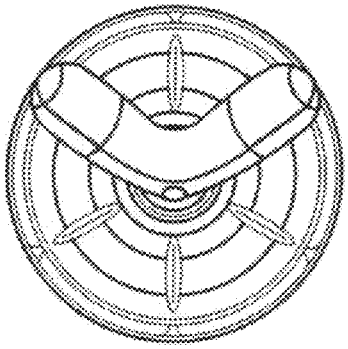
FIG. 2 is a top view thereof.
Figure 3:
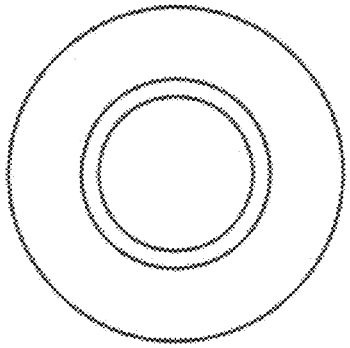
FIG. 3 is a bottom view thereof.
Figure 4:
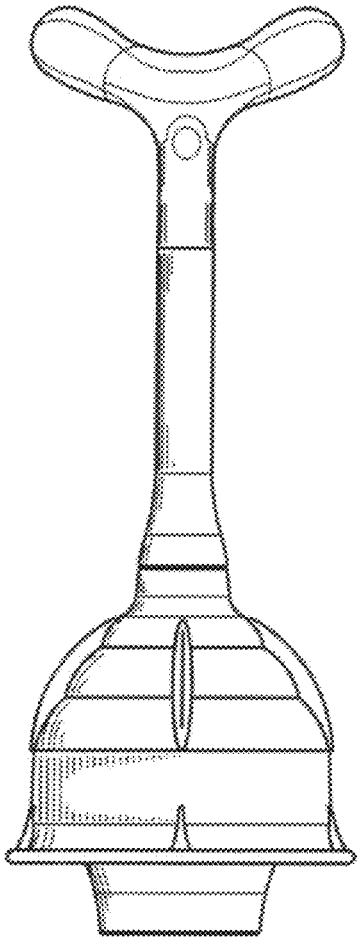
FIG. 4 is a front view thereof.
Figure 5:
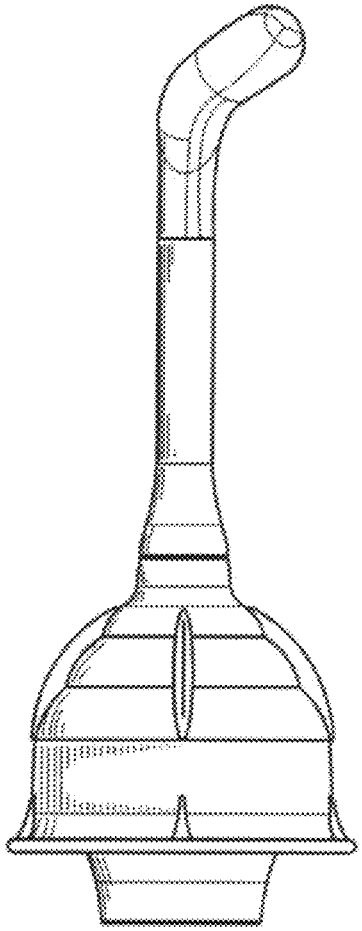
FIG. 5 is a side view thereof.

The best mode for carrying out the invention is presented in terms of its preferred embodiment, herein depicted within the Figures.

1. Detailed Description of the Figures

A preferred embodiment of the present improved air blasting device for plumbing purposes is hereinafter referred to as a plunger 10 for convenience, and it is shown in FIGS. 1-7 according to the present invention. The plunger 10 is shown to comprise a shaft 12 (hereinafter synonymously referred to as "stem") vertically extending upwards from a crest of an improved, inverted rubber plunger cup 14.

A handle 18 is attached to the top distal end of the shaft 12. The handle 18 is a generally a V-shaped handle having mirrored arms 20 that face inwards (refer to FIG. 2). The effect of the angled inward V-shaped arms 20 is that neither of them nor the shaft 12 shares a vertical or a horizontal plane; hence, all of the arms and the shaft travel in separate planes. Each of the arms 20 angle inwards (refer to FIG. 5), where it is anticipated a user stands relative to the plunger 10. The angling and/or over-molding of the arms 20 both provide the user with a more ergonomic gasp of the handle. It keeps the user's hands off of the shall 12. It provides the user with a two-handed plunge with a greater force towards the mouth of the to-be-plunged pipe. A second advantage of the arms angled inwards is that the user does not need to hover over the plunger in a manner similar to that for conventional plungers; rather, the user can simply extend forearms outwards so that there is less risk of any splatter on his or her upper-attire.

In is anticipated that one potential advantage of the present handle 18 is that it may be removably detached so that it can be washed, disinfected, and sanitized.

Figure 6:
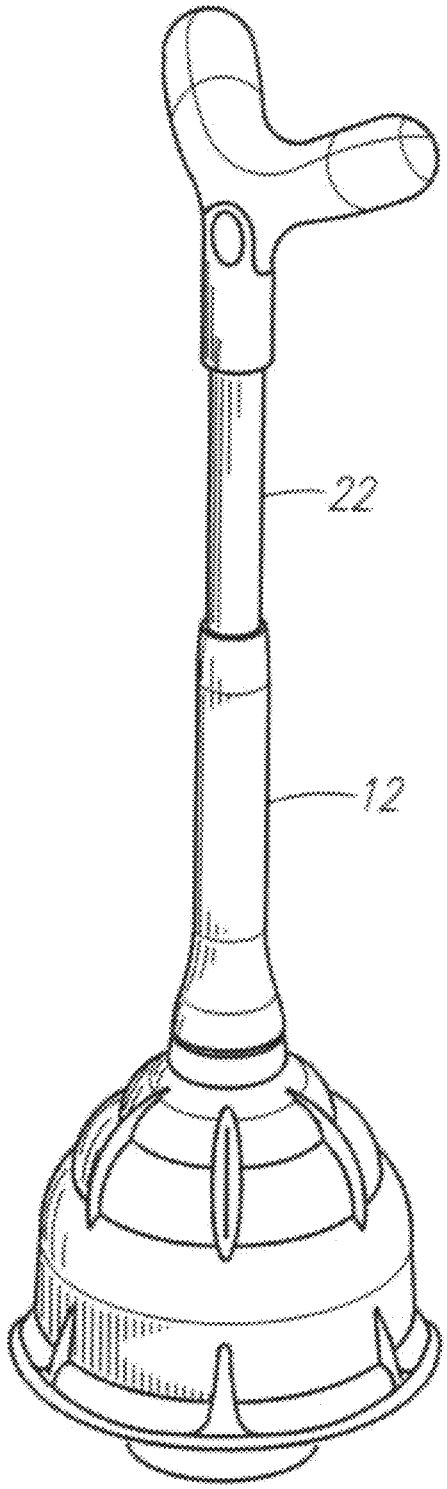
FIG. 6 is an elevational view of the plunger comprising an extension shaft portion.
Figure 7:
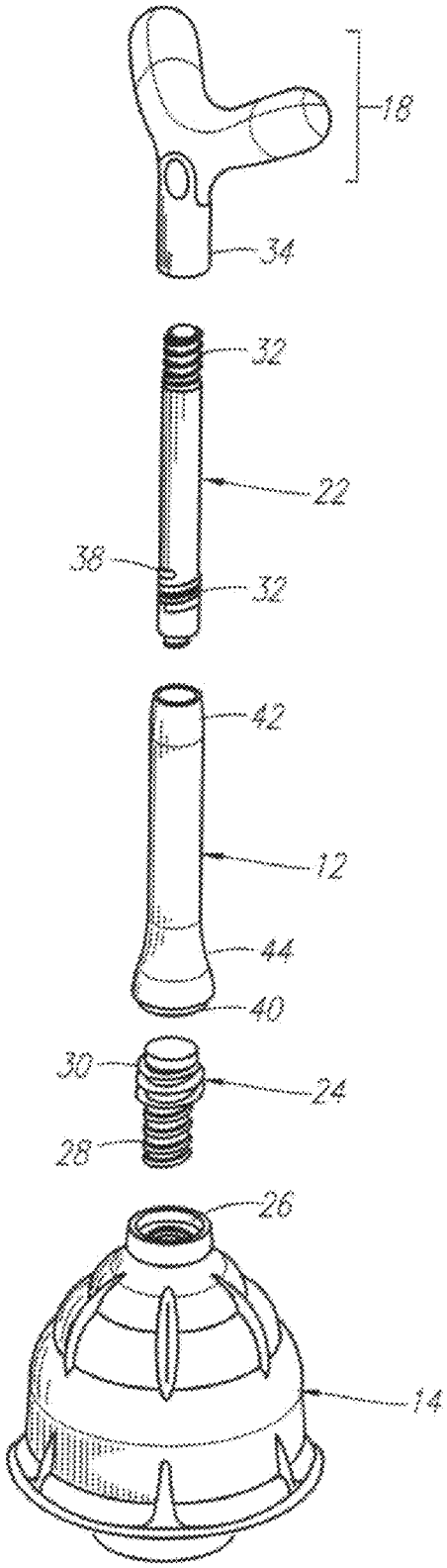
FIG. 7 is an exploded view of the plunger in FIG. 6.
Figure 8:
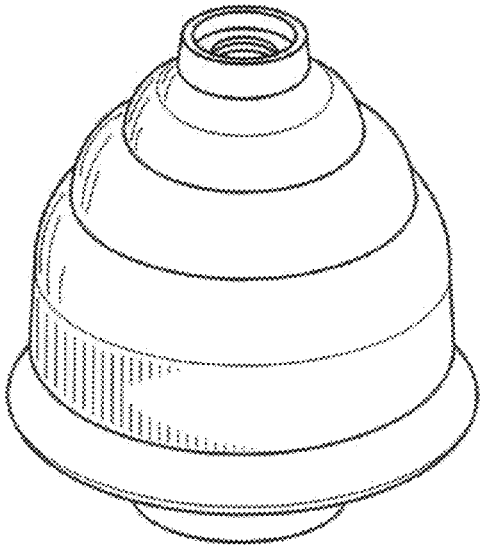
FIG. 8 is a top-elevational view of a plunger cup for the plunger.
Figure 9:
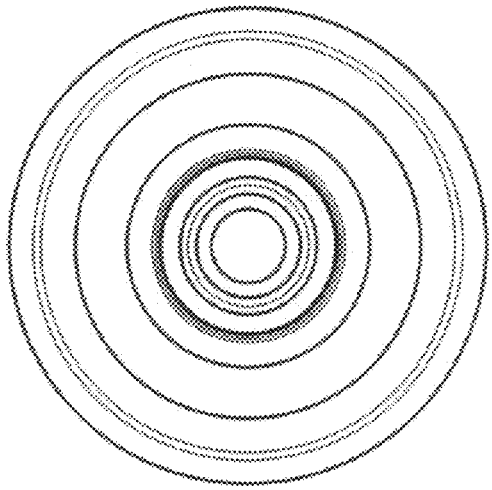
FIG. 9 is a top view of the cup shown in FIG. 8.
Figure 10:
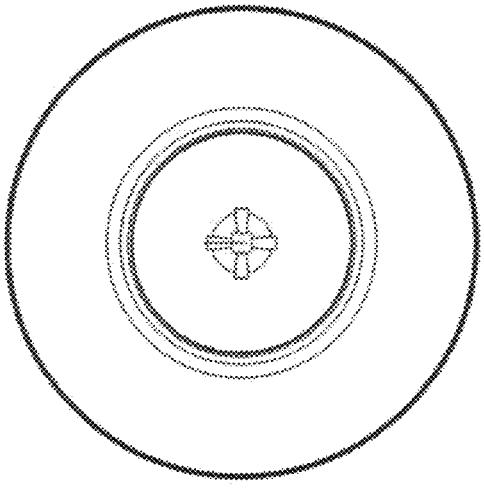
FIG. 10 is an underside view of the cup shown in FIG. 8.
Figure 11:
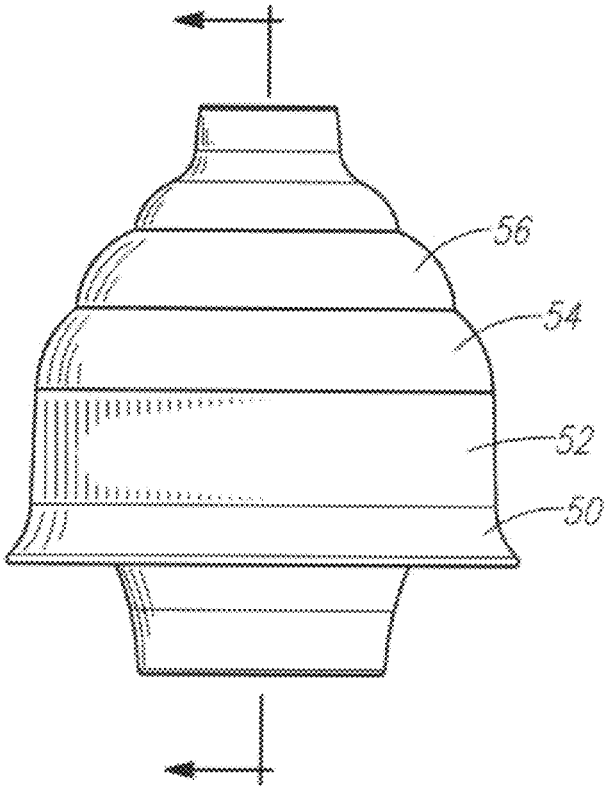
FIG. 11 is a side view of the cup shown in FIG. 8.
Figure 12:
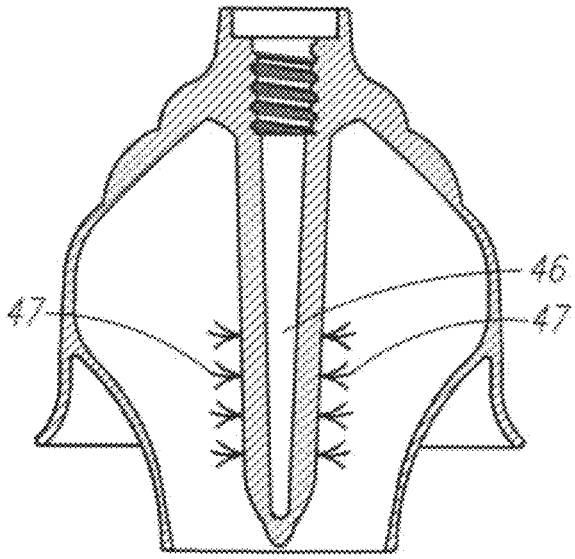
FIG. 12 is cross-section of the cup taken along lines XI-XI in FIG. 11.
Figure 13:
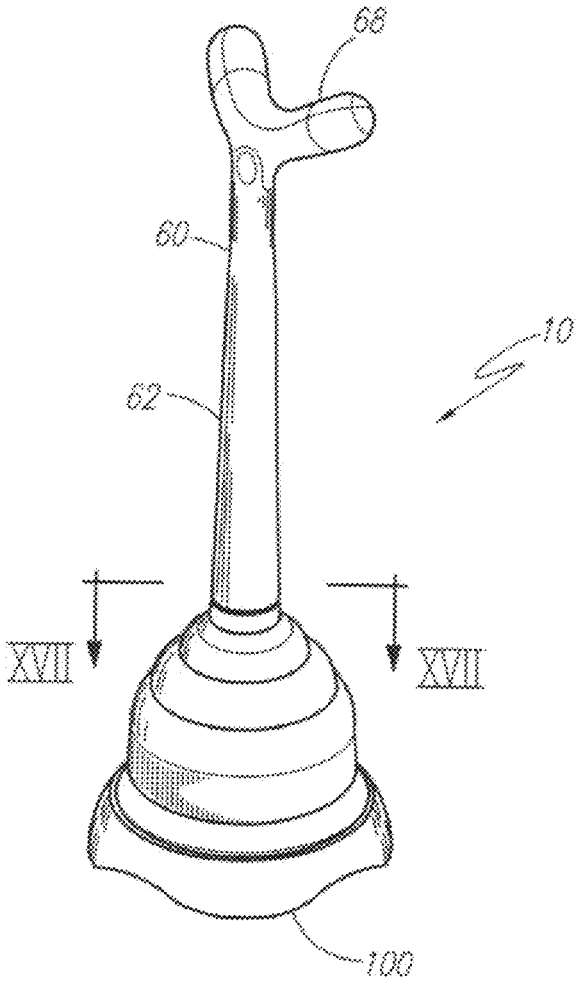
FIG. 13 is a perspective view of an alternate embodiment of an improved plunger according to an alternate embodiment of the present invention, and incorporating a supporting drip guard 100.
Figure 14:
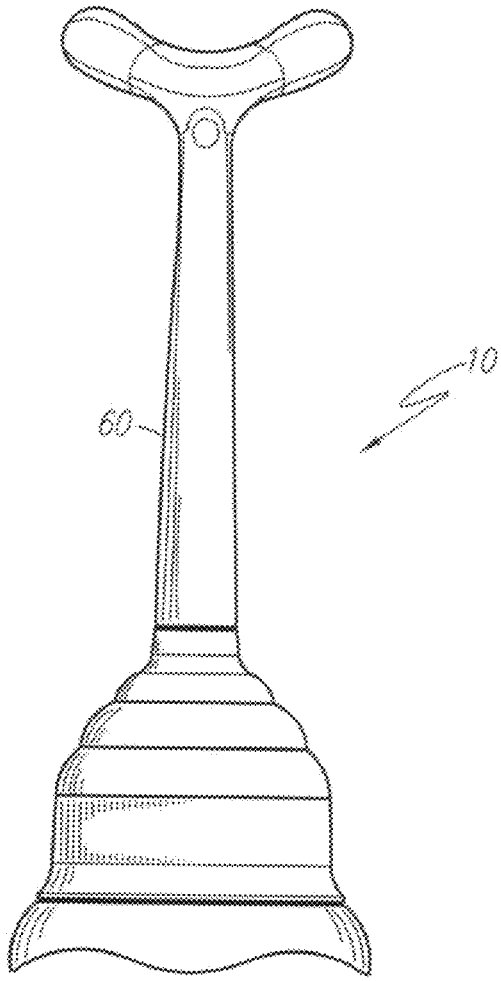
FIG. 14 is a front elevational view thereof.
Figure 15:
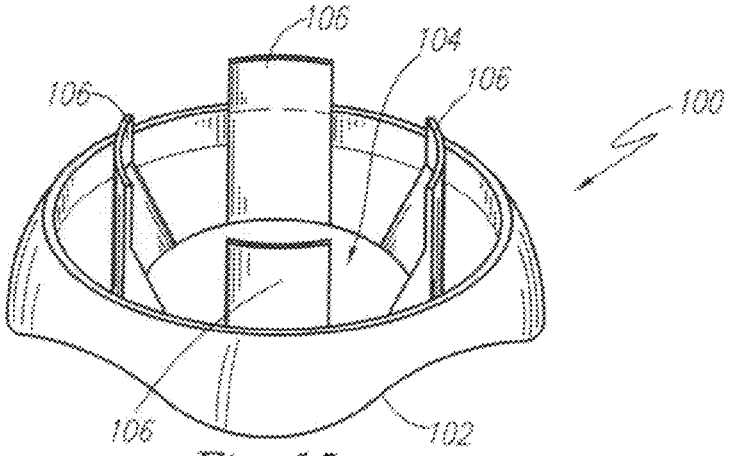
FIG. 15 is a detailed perspective of the supporting drip guard 100 shown alone.
Figure 16:
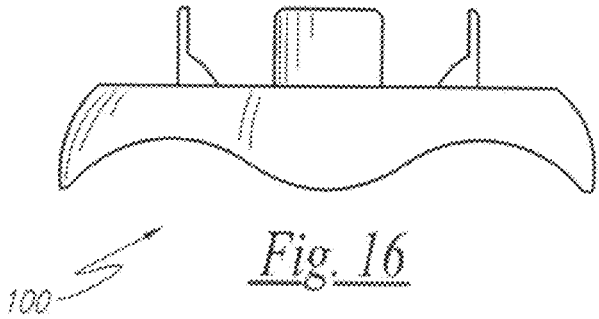
FIG. 16 is a front elevational view of the drip guard 100 of FIG. 15.
Figure 17:
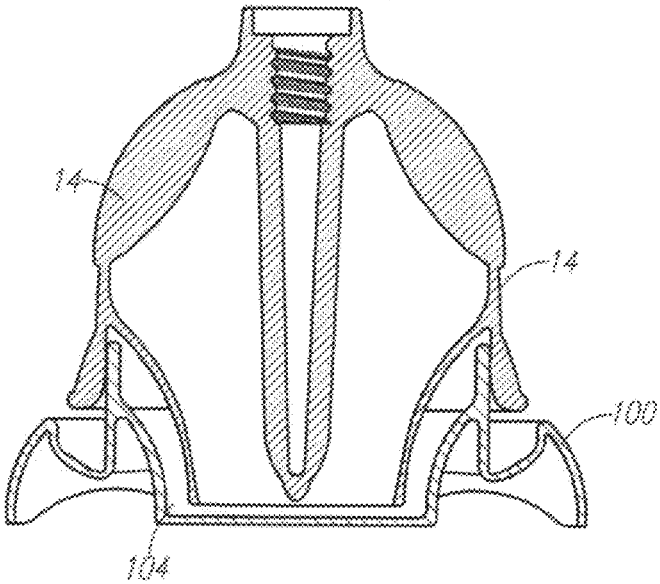
FIG. 17 is a cross sectional view taken alone line XVII-XVII of FIG. 13.
Figure 18:
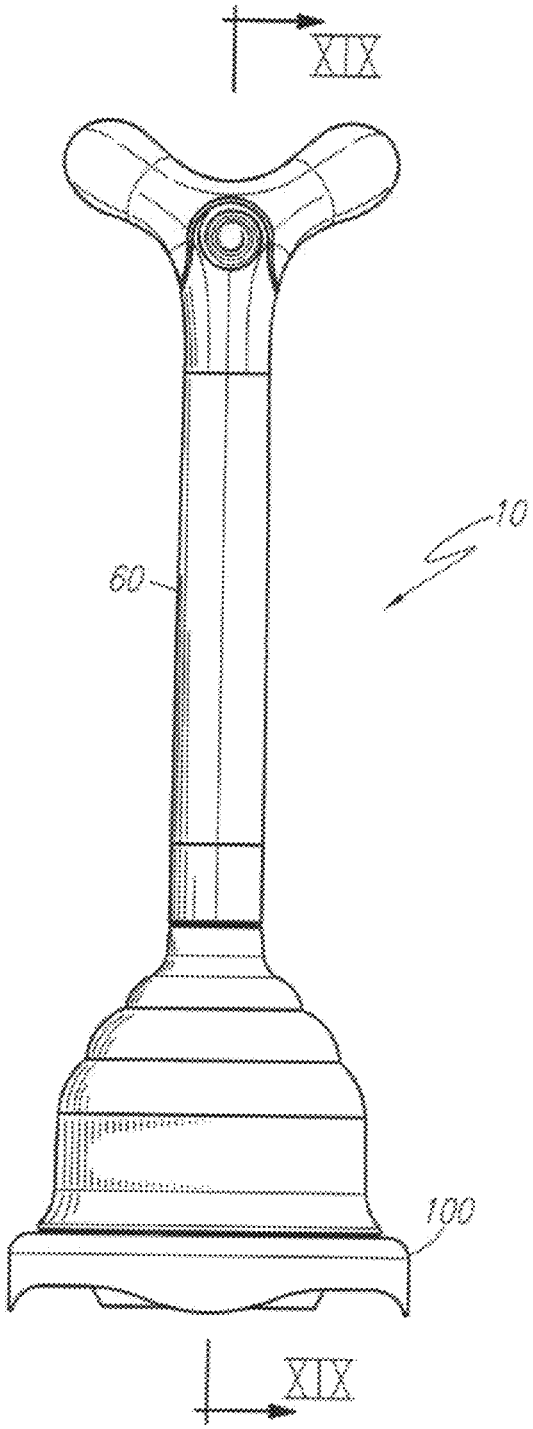
FIG. 18 is a perspective view of a second alternate aesthetic embodiment of an improved plunger according to an alternate embodiment of the present invention, and incorporating a supporting drip guard 100.
Figure 19:
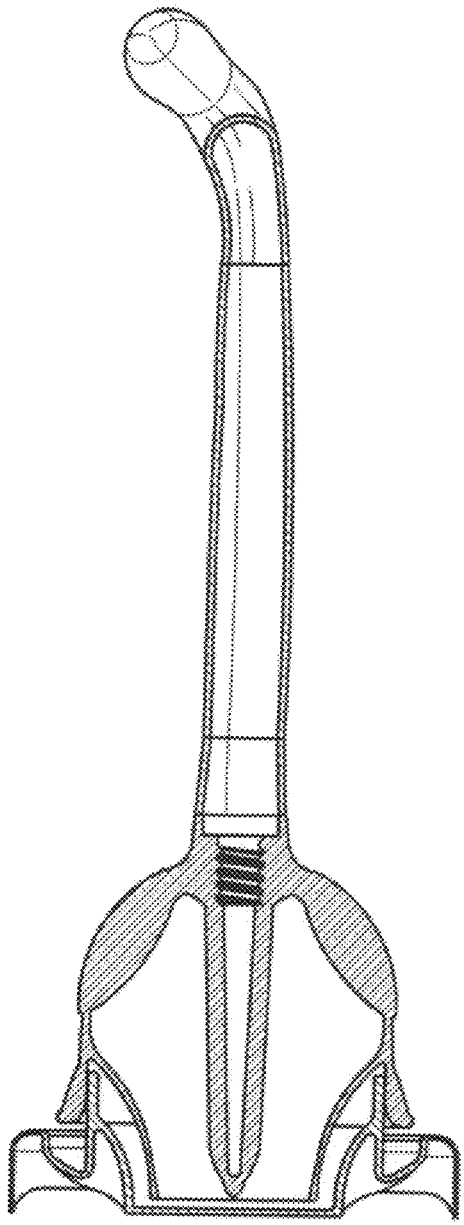
FIG. 19 is a cross sectional view thereof taken along line XIX-XIX of FIG. 18.
Figure 20:
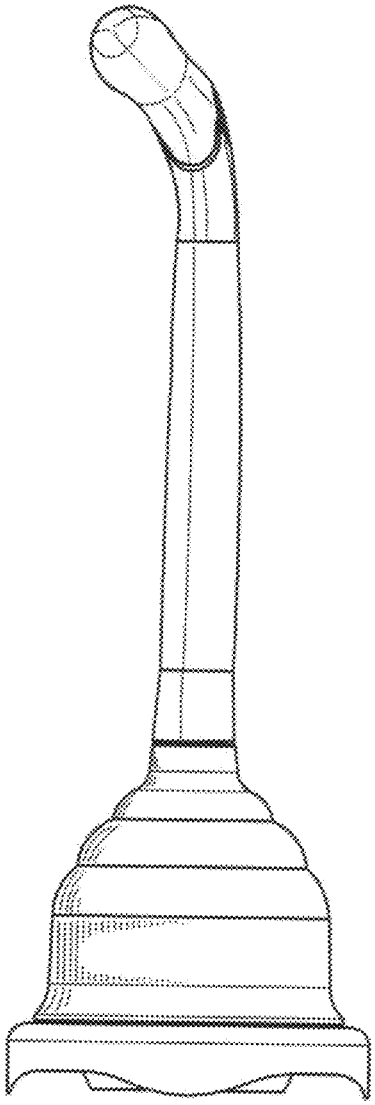
FIG. 20 is a side elevational view thereof.
Figure 21:
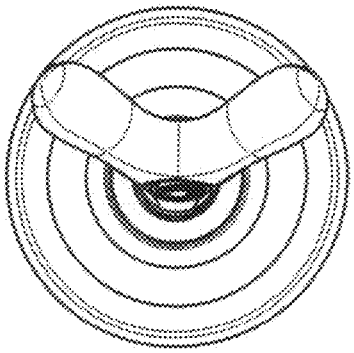
FIG. 21 is a top view thereof.
Figure 22:
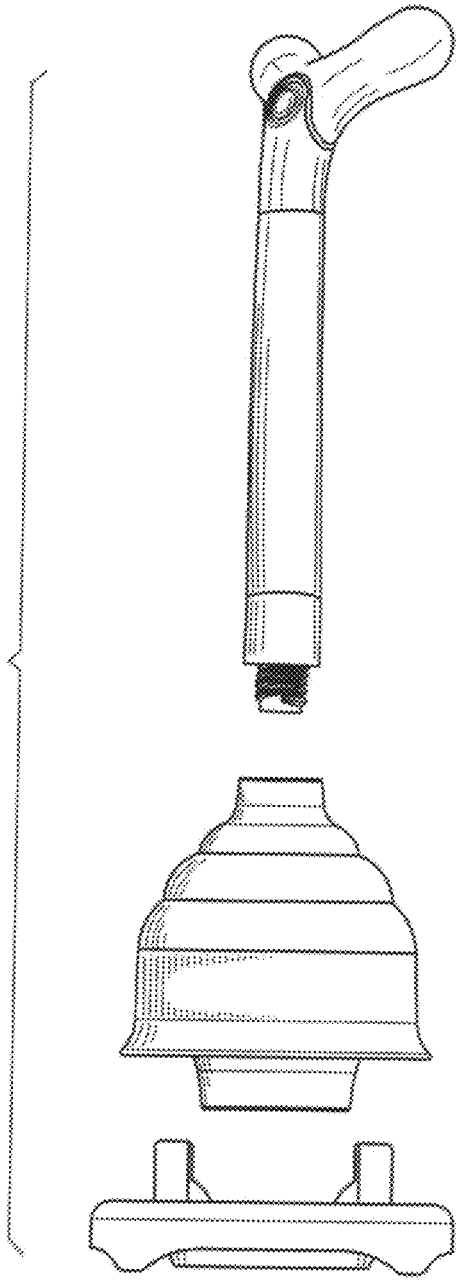
FIG. 22 is an exploded elevational view thereof.

It is anticipated that another feature of the improved plunger 10 is an improved shaft 22. In any embodiment, it is believed that the shaft 22 terminates at its lowermost end as a smooth transition to the upper crest of the plunger cup 14. The smooth transition prevents an accumulation of waste or unsanitary water within any ledges, notches, cavities or the like. An alternate embodiment anticipates at least one extension shaft portion 22. The extension shaft portion 22 is shown in FIG. 6 to extend a height of the shaft 12. The extension shall portion 22 can remain extended on the shaft 12 for use, or it can retract to allow the entire device to be easily stored under a sink or vanity. Alternate embodiments may include only one fixed, non-collapsible length of shaft that equals the present main shaft and extended shaft combined. In operation, the extension shaft portion 22 collapses for storage in the shall 12, where the former and the latter essentially act as telescoping members. An exploded view of the plunger 10 is shown in FIG. 7 to show a preferred means to attach and detach the components of the plunger. A threaded rod 24 is an attachment means that is used to connect the shaft 12 to the plunger 14.

A cavity 26 at a crest of the plunger 14 travels a vertical depth that accommodates a first length 28 of the threaded rod 24. That first length 28 of the threaded rod 24 comprises a circumference slightly smaller than that of the cavity 26. A second, remaining length 30 of the threaded rod 24 comprises a second circumference slightly smaller than that of a hollow depth 40 at least at a distal end of the shaft 12. The cavity 26 comprises corresponding threads across its inner wall that mate with those on the first length 28 of the rod 24. The cavity 26 receives that first length of the rod 24 while the second, remaining length 30 is received in the shaft 12. That hollow depth at the distal end of the shaft 12 comprises corresponding threads along the inner shaft wall which mate with those on the second, remaining length 30. In the foregoing manner, the shaft 12 is attached to the plunger 10.

The lower distal end of the shaft 12 flanges outwards so that it can completely enclose the outer walls of the cavity 26 when the shaft is connected to the plunger cup 14. The flange 44 prevents waste water from accumulating in the cavity; it prevents a risk of any water getting stuck there during the plunger's non-use, where it would breed growth of harmful bacteria.

The shaft 12 comprises a cross-section slightly greater than that of the extension shaft portion 22 so that the latter can be stored and contained in the former when the entire shaft is not extended in height. The extension shaft portion 22 also comprises a threaded distal length 32 that mates with corresponding threads along an inner cavity wall formed at the base 34 of the handle 18 where the arms 20 meet. The base 34 is namely a leg that extends vertically downward a partial length where the arms 20 meet.

The opposing distal end of the extension shaft portion 22 comprises a threaded length 36 and/or a catch-lock 38. The extension shaft portion 22 collapses and stores in the shaft 12 while the plunger 20 is stored in a concealed cabinet space; however, the handle 18 is used to pull the extension shall portion upwards above the shaft to extend the plunger's overall height immediate to the plunger's use. To secure the lengthened height, the extension shaft portion 22 is first pulled upwards its entire length, and it is then rotated so that its threaded length mates with a corresponding length comprised on the inner shaft wall proximate to the corresponding top distal end of the shaft 12. The threaded engagement secures the extended shaft height so that the user can next use the plunger to plunge.

The present invention is not limited to the threaded rod 24 and the threaded attachment means taught throughout this invention to secure the various components: rather, any attachment means is envisioned to be within the embodiments taught herein if they accomplish the same or similar purpose. One such example of an alternate embodiment is a plunger having a handle with only one-arm instead of the mirrored arms of the "V" shape, wherein that one arm travels both upwards and away form the base so that it is essentially angled.

It is anticipated that another feature of the improved plunger 10 is the improved plunger cup 14, which forms an increased volumetric capacity. FIGS. 8-11 shows the improved plunger cup 14. A typical cup comprises a continuous sidewall that extends nearly vertically upwards a height before it tapers to a horizontal plane proximate to the crest. The present cup comprises rim 50 that flanges outwards before a first continuous sidewall 52 extends nearly vertically upwards: however, a second continuous sidewall 54 affixes to the first sidewall where the first begins to taper to a horizontal plane. The second continuous sidewall 54 next extends nearly vertically upwards to extend a height, and hence a volume, of the plunger cup 14. A third continuous sidewall 56 affixes to the second continuous sidewall 54 when the second begins to taper another horizontal plane. There is no limit to the number of continuous sidewalls utilized, but each continuous sidewall comprises a circumference smaller than a last such that the plunger cup is embodied as a plurality of concentric, stacked sidewalls. The final sidewall, shown herein as the third continuous sidewall 56, tapers towards a horizontal plane, but it does not crest in a conventional manner: rather, it travels a short distance in the horizontal plane before it tapers again upwards in the vertical plane, where it terminates at a mouth of the cavity 26.

The plunger cup 14 is shown to comprise the foregoing features; however, embodiments including the handle and the shall feature of this invention may be utilized with alternate cup designs including, but not limited to, conventional flanged and flat rimmed cups.

A further feature of the present invention includes a dislodging protrusion 46 that shares a longitudinal axis with the shall 12. The dislodging protrusion 46 protrusion downwards from the inner-sidewall of the plunger cup 14 just beneath the crest. Ideally, it extends from an underside of the bottom-wall of the cavity. The dislodging protrusion 46 is preferably a dull spike that protrudes past the cross-plane formed at the cup's rim(s) when the plunger is compressed. The dislodging protrusion 46 physically breaks up clogs. In further embodiments, the dislodging protrusion 46 may comprise stiff bristles 47 that extend outwards from at least a portion of its surface. It is anticipated that the bristles can catch hair that clogs sing and shower drains, so that it can be pulled out therefrom.

Referring now to FIG. 13-17, and alternate embodiment of the present improved air blasting device for plumbing purposes 10 is shown. The plunger 10 of this embodiment is shown having an alternate unitary handle 60 is shown having the shaft 62 and handle 68 formed integrally as a unitary element. The handle 68 is formed terminated the top distal end of the shaft 62 and is a generally a V-shaped handle having mirrored arms 70 that face inwards in a similar manner and effect as the angled inward V-shaped arms 20 of the previously described embodiments. The advantages of such a design are twofold: first, such as design can be commercially manufactured via a blow-molding process to allow for sufficient strength and performance all in an economical manner; and second, an improved industrial design aesthetic can be achieved.

It is anticipated that another feature described in the alternate embodiment is the use and incorporation of a supporting drip guard 100. As shown in greater detail in FIG. 15-17, the drip guard 100 forms a stabilizing base 102 opposite of and forming a liquid retention cavity 104. Extending upward from the liquid retention cavity 104 are a plurality of pedestal extensions 106 extending upward therefrom. The extensions 106 coordinate to receive and support the plunger cup 14, while at the same time guiding and urging the shedding of any fluid from the inner or outer surface of the cup 14 downward to the common liquid retention cavity 104.

2. Operation of the Preferred Embodiment

To use the present invention, the plunger is removed form its storage location in the collapsed state. The handle is used to pull the extension shaft portion upwards and away from the temporary housing in the main shaft portion. The extension shaft portion is rotated to secure the extension shaft portion maintains the extended height of the shaft. The flange or the rim of the plunger cup is sealed over the mouth of a toilet pipe or drain with the arms of the inward-facing V-shaped handle facing towards or away from the user, which ever grip is more comfortable to the user. The user wraps each hand around one of the arms and pushes downwards on them to force a plunge. The plunger cup depresses in a manner similar to other plunges to loosen a clog, but with a larger volume of air and pressure generated.

When the blockage is removed, the user can unscrew the handle from the top portion of the extension shaft arm to wash and disinfect it. After the handle is reassembled thereon, the extension shaft portion is rotated in a counter direction so that it can collapse into the shaft. The plunger is placed in the concealed storage location.

The foregoing descriptions of the specific embodiments of the present invention have been presented for the purposes of illustration and description. They are neither intended to be exhaustive nor to limit the invention to the precise forms disclosed and obviously, many modifications and variations are possible in light of the above teachings. The embodiments were chosen and described in order to best explain the principles of the invention and its practical application, to thereby enable others skilled in the art to best utilize the invention and its various embodiments with various modifications as are suited to the particular use contemplated. It is intended that the scope of the invention be defined by the Claims appended hereto and to their equivalents. Therefore, the scope of the invention is to be limited only by the following claims.

Having thus described the invention what is claimed as new and desired to be secured by Letters Patent is as follows:

1. An improved plunger comprising:

a hollow shaft vertically extending upwards from a crest of an inverted rubber plunger cup;

a generally V-shaped handle attached to a top distal end of said shaft, wherein said handle comprises: two mirrored arms that face inwards so that neither of said arms nor said shaft share a vertical or a horizontal plane; hence, all of the arms and the shaft travel in separate planes, said handle further is removably detachable from said plunger so that it can be washed, disinfected, and sanitized;

a base that is a leg vertically extending downwards a length where said arms meet;

at least one extension shaft portion to extend a height of said shaft;

a threaded rod to connect said shaft to said plunger;

a cavity at a crest of said plunger cup that travels a vertical depth to accommodate a first length of said threaded rod, wherein said first length of said threaded rod comprises a circumference slightly smaller than that of said cavity; and, a second, remaining length of said threaded rod comprising a second circumference slightly smaller than that of a hollow depth protruding from at least at a distal end of said shaft, wherein said depth at said distal end of said shaft comprises corresponding threads along an inner shaft wall which mate with those on said second, remaining length;

wherein said cavity comprises corresponding threads across its inner wall that mate with those on said first length of the rod;

wherein said cavity receives said first length of said rod while said second, remaining length is received in said depth of said shaft.

2. The plunger of claim 1, wherein said shaft comprises a cross-section slightly greater than that of said extension shaft portion so that a latter can collapse into and be housed in a former.

3. The plunger of claim 1, wherein said extension shaft portion comprises a threaded distal length that mates with corresponding threads along an inner cavity wall formed at a base of said handle.

4. The plunger of claim 1, wherein a lower distal end of said extension shaft portion comprises a threaded length that mates with a corresponding threaded length comprised on an inner shaft wall proximate to a corresponding to distal end of said shaft.

5. The plunger of claim 1, wherein said plunger cup comprises:

a rim that flanges outwards before a first continuous sidewall extends nearly vertically upwards;

a second continuous sidewall affixed to said first sidewall where said first continuous sidewall begins to taper to a horizontal plane, said second continuous sidewall next extends nearly vertically upwards to extend a height, and hence a volume, of said plunger cup; and, a third continuous sidewall affixed to said second continuous sidewall when said second continuous sidewall begins to taper another horizontal plane, said third continuous sidewall tapers inward toward and travels a short distance in a third horizontal plane before it tapers again upwards in a vertical plane where it terminates at a mouth of a cavity;

wherein each of said continuous sidewalls comprises a circumference smaller than a last such that said plunger cup is embodied as a plurality of concentric, stacked sidewalls.

6. The plunger of claim 1, wherein said plunger cup comprises a dislodging protrusion in a form of a dull spike that shares a longitudinal axis with said shaft, said dislodging protrusion protrudes downwards from an inside of a continuous sidewall of said plunger cup just beneath the crest; wherein said dislodging protrusion protrudes past a cross-plane formed at said plunger cup's rim when said plunger is compressed.

7. The plunger of claim 6, wherein said dislodging protrusion comprises stiff bristles that extend outwards from at least a portion of its surface.

8. The plunger of claim 1, further comprising:

a shaft vertically extending upwards from a crest of an inverted rubber plunger cup, wherein said plunger cup comprises;

a rim that flanges outwards before a first continuous sidewall extends nearly vertically upwards;

a second continuous sidewall affixed to said first sidewall where said first continuous sidewall begins to taper to a horizontal plane, said second continuous sidewall next extends nearly vertically upwards to extend a height, and hence a volume, of said plunger cup; and, a third continuous sidewall affixed to said second continuous sidewall when said second continuous sidewall begins to taper another horizontal plane, said third continuous sidewall tapers inward toward and travels a short distance in a third horizontal plane before it tapers again upwards in a vertical plane where it terminates at a mouth of a cavity;

wherein each of said continuous sidewalls comprises a circumference smaller than a last such that said plunger cup is embodied as a plurality of concentric, stacked sidewalls.

9. The plunger of claim 8, wherein said plunger cup comprises a dislodging protrusion in a form of a dull spike that shares a longitudinal axis with said shaft, said dislodging protrusion protrudes downwards from an inside of a continuous sidewall of said plunger cup just beneath the crest;

wherein said dislodging protrusion protrudes past a cross-plane formed at said plunger cup's rim when said plunger is compressed.

10. The plunger of claim 8, wherein said shaft further comprises a generally V-shaped handle attached to a top distal end of said shaft.

11. The plunger of claim 10, wherein said handle comprises:

two mirrored arms that face inwards so that neither of said arms nor said shaft share a vertical or a horizontal plane; hence, all of the arms and the shaft travel in separate planes; and, a base that is a leg vertically extending downwards a length where said arms meet.

12. The plunger of claim 8, further comprising, in combination, a supporting drip guard, wherein said drip guard received and support said plunger.

13. The plunger of claim 12, wherein said drip guard comprises:

a stabilizing base opposite of and forming a liquid retention cavity;

a plurality of pedestal extensions extending upward from the liquid retention cavity.

14. The plunger of claim 13, wherein said pedestal extensions coordinate to receive and support said plunger cup, while at the same time guiding and urging the shedding of any fluid from the inner or outer surface of the cup downward to the common liquid retention cavity.

* * * * *